US007178170B2

(12) United States Patent
Thompson

(10) Patent No.: US 7,178,170 B2
(45) Date of Patent: Feb. 20, 2007

(54) LAP BIB DEVICE FOR USE IN A VEHICLE OR THE LIKE

(76) Inventor: Deborah A. Thompson, 202 Carryback Dr., Marietta, GA (US) 30068

( * ) Notice: Subject to any disclaimer, the term of this patent is extended or adjusted under 35 U.S.C. 154(b) by 0 days.

(21) Appl. No.: 11/249,090

(22) Filed: Oct. 12, 2005

(65) Prior Publication Data

US 2006/0080751 A1 Apr. 20, 2006

Related U.S. Application Data

(60) Provisional application No. 60/619,137, filed on Oct. 15, 2004.

(51) Int. Cl.
*A41D 13/04* (2006.01)

(52) U.S. Cl. ..... 2/48

(58) Field of Classification Search ..... 2/48, 2/46, 47, 49.1, 51, 52, 49.2–49.5, 50; 108/67, 108/43

See application file for complete search history.

(56) References Cited

U.S. PATENT DOCUMENTS 1,135,833 A * 4/1915 Morse ..... 2/48
1,538,982 A * 5/1925 Glover ..... 2/51
1,970,307 A * 8/1934 Hartmann ..... 2/48
1,979,879 A * 11/1934 Harris ..... 2/48
2,364,258 A * 12/1944 Wallace ..... 2/51
3,115,639 A * 12/1963 Moszczynski ..... 2/48
4,837,859 A * 6/1989 Hamberg ..... 2/467
4,958,577 A * 9/1990 Demaio et al. ..... 108/67
5,075,897 A * 12/1991 Daniels ..... 2/48
5,220,692 A 6/1993 Cox
5,244,278 A * 9/1993 Robitaille ..... 383/4
5,509,141 A * 4/1996 Saltzman ..... 2/49.2
5,513,576 A * 5/1996 Ward ..... 108/43
5,530,968 A 7/1996 Crockett
5,621,916 A 4/1997 Bell
5,671,479 A * 9/1997 Dedrick ..... 2/46
5,701,605 A 12/1997 Bowen
5,960,472 A * 10/1999 Reid ..... 2/48
6,095,058 A 8/2000 Earnhart
6,243,869 B1 * 6/2001 Ekovich ..... 2/48
6,484,333 B1 * 11/2002 Hill ..... 2/49.4
6,839,907 B2 * 1/2005 Katz ..... 2/48
2001/0054191 A1 * 12/2001 Frye ..... 2/49.2

* cited by examiner

*Primary Examiner*—A. Vanatta
(74) *Attorney, Agent, or Firm*—Clements Walker; Christopher L. Bernard

(57) ABSTRACT

The present invention provides a lap bib for use in a vehicle or the like. The lap bib includes a lap portion for covering the lap of a user, an abdomen portion for covering the abdomen of the user, and an attached closure band for conveniently stowing and transporting the lap bib when not in use. Advantageously, the lap bib protects the user's clothing while the user is eating or the like in an automobile; on a bus, train, or boat; in an airplane; at their desk; or the like.

10 Claims, 3 Drawing Sheets

LAP BIB DEVICE FOR USE IN A VEHICLE OR THE LIKE

CROSS-REFERENCE TO RELATED APPLICATION(S)

The present non-provisional patent application claims the benefit of priority of U.S. Provisional Patent Application Ser. No. 60/619,137, entitled "LAP BIB FOR USE IN A VEHICLE OR THE LIKE," and filed on Oct. 15, 2004, which is herein incorporated in full by reference.

FIELD OF THE INVENTION

The present invention relates generally to a lap bib device for use in a vehicle or the like. The lap bib includes a lap portion for covering the lap of a user, an abdomen portion for covering the abdomen of the user, and an attached closure band for conveniently stowing and transporting the lap bib when not in use. Advantageously, the lap bib protects the user's clothing while the user is eating or the like in an automobile; on a bus, train, or boat; in an airplane; at their desk; or the like.

BACKGROUND OF THE INVENTION

Because of the mobile and harried lifestyle of today, many people must eat and the like on the run. This inevitably leads to spills and drips, which may cause undesirable clothing stains. Several aprons, bibs, lap mats, and other products have been developed and marketed to deal with this problem.

For example, U.S. Pat. No. 5,220,692, issued to Cox (Jun. 22, 1993), discloses an apron that may be worn by the driver of a vehicle that protects his or her clothing from spilled food or beverage, or falling cigarette or cigar ashes, while he or she is eating or smoking while driving. The apron may be put on or taken off with one hand by making a single connection. The apron includes a torso panel and a lap panel, the former being removably connected to a neck strap. The lap panel covers the thighs and knees of the driver. The sides of the lap panel are stiffened by weights maintaining the lap panel flat on the thighs of the driver and preventing it from creeping up over the knees of the driver despite the movement of the driver's legs as he or she operates the pedals of the vehicle. The apron is made of a water-repellant, moisture-breathing, fire-retardant fabric.

U.S. Pat. No. 5,530,968, issued to Crockett (Jul. 2, 1996), discloses a commuter's apron that provides for the containment of food and drink spillage for automobile and other vehicle drivers and passengers, while the vehicle is moving or stopped. The apron is formed of a relatively thin sheet of polyethylene plastic or other material (e.g. coated paper or fabric) in order to be impervious to liquid and other spills. The upper and lower edges of the apron are congruent, thus enabling a plurality of the aprons to be die cut or otherwise formed continuously from a single elongate sheet or roll of material with relatively little waste. All of the flat portions of the apron (i.e. the main body, the pocket portion, and the neck closure portion) are formed from a single, continuous sheet, with the only additional components required being tape or other means to close the neck closure portion and seal the sides of the pocket portion in the event that heat sealing is not used. Thus, the apron may be provided inexpensively with fast food meals and/or dispensed from a container having a plurality of the aprons packaged separately therein. The apron may include an advertising or display message thereon, if desired.

U.S. Pat. No. 5,621,916, issued to Bell (Apr. 22, 1997), discloses a bib specifically adapted to be worn while an operator is controlling a vehicle. The device defines particular application while an operator is eating and/or drinking while controlling a vehicle. In its broadest context, the device includes a sheet of material having a first end and a second end and an intermediate extent therebetween, wherein the intermediate extent is of a greater width than the first end and the second end. Furthermore, a steering column ring is adapted to be secured to the first end of the sheet while a neck ring is adapted to be secured to the second end of the sheet. Thus, in operation, the operator affixes the neck ring about his or her neck and the steering column ring about the steering column of the vehicle, employing the sheet as a bib.

U.S. Pat. No. 5,701,605, issued to Bowen (Dec. 30, 1997), discloses a foldable and reusable bib that includes a flat, relatively stiff sheet having a long axis and a width. The flat sheet includes a transverse fold line, transverse to the long axis and extending across the width of the sheet, thereby dividing the sheet into an upper portion and a lower portion. The upper portion is defined by two side edges and a top edge, wherein the top edge has an arcuate section disposed about the long axis and forming part of an aperture in the flat sheet. Each upper portion side edge slopes and extends from the transverse fold line to the top edge. In another embodiment, the upper portion includes a plurality of angled fold lines proximate each side edge to form a backward-folding wing section. Preferably, either bib is made from a recyclable material, such as a corrugated paper product.

Finally, U.S. Pat. No. 6,095,058, issued to Earnhart (Aug. 1, 2000), discloses a lap mat for overlaying a person's lap that includes openings for holding a beverage container and food items. A pocket is located under the openings and resides between the person's legs when the lap mat overlays the person's lap. The pocket provides thermal insulation for and containment of the beverage container and food items inserted into the openings. The lap mat offers a convenient holder for the person to place a beverage container or food item in while seated, such as when operating or riding in a vehicle. Also, the lap mat protects the person's lap and clothing from spills.

The aprons, bibs, lap mats, and other products described above, however, suffer from significant drawbacks. The aprons and bibs, for example, are difficult for a user to manipulate, as they must be placed around the user's neck. This also makes the aprons and bibs aesthetically unappealing and therefore less likely to be purchased and used. The lap mats, for example, provide little protection for a user's abdomen. In addition, none of the aprons, bibs, lap mats, or other products described above are convenient to stow and transport.

Accordingly, the lap bib device of the present invention addresses these drawbacks.

BRIEF SUMMARY OF THE INVENTION

In various embodiments, the present invention provides a lap bib device for use in a vehicle or the like. The lap bib includes a lap portion for covering the lap of a user, an abdomen portion for covering the abdomen of the user, and an attached closure band for conveniently stowing and transporting the lap bib when not in use. Advantageously, the lap bib protects the user's clothing while the user is eating or the like in an automobile; on a bus, train, or boat; in an airplane; at their desk; or the like.

In one specific embodiment of the present invention, a bib device for covering the lap and abdomen of a user includes a lap portion for covering the lap of the user; an abdomen portion for covering the abdomen of the user; and a closure band attached to the lap portion, the closure band disposed about the lap portion and the abdomen portion when the bib device is in a stowed configuration.

In another specific embodiment of the present invention, a method for providing a bib device for covering the lap and abdomen of a user includes providing a lap portion for covering the lap of the user; providing an abdomen portion for covering the abdomen of the user; and providing a closure band attached to the lap portion, the closure band disposed about the lap portion and the abdomen portion when the bib device is in a stowed configuration.

BRIEF DESCRIPTION OF THE DRAWINGS

The lap bib device of the present invention is illustrated and described herein with reference to various drawings thereof, with like reference numbers referring to like components throughout, in which.

DETAILED DESCRIPTION OF THE INVENTION

Figure 1:
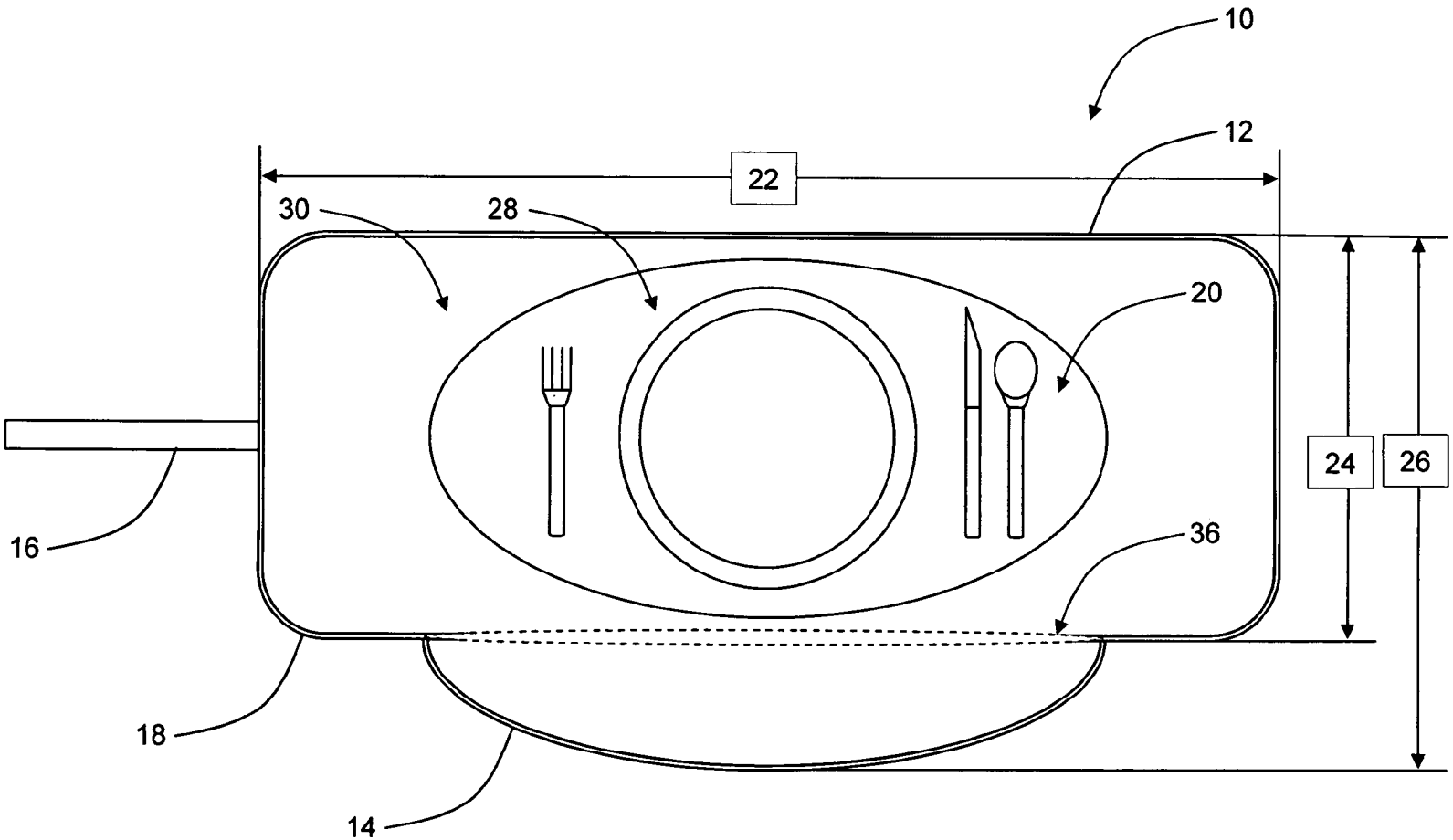
FIG. 1 is a top plan view of one embodiment of the lap bib of the present invention, the lap bib including a lap portion for covering the lap of a user, an abdomen portion for covering the abdomen of the user, and an attached closure band for conveniently stowing and transporting the lap bib when not in use.
Figure 2:
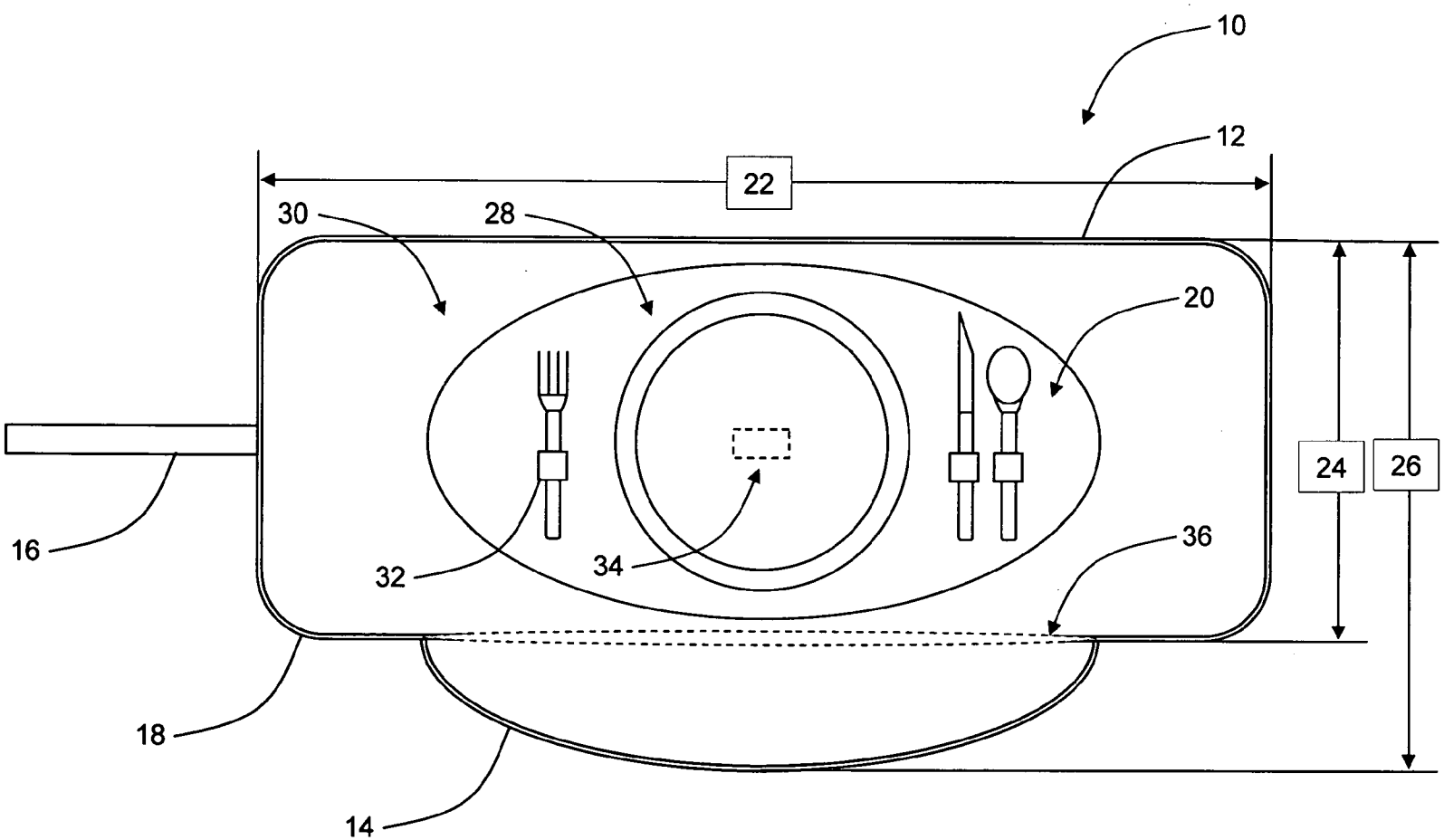
FIG. 2 is a top plan view of another embodiment of the lap bib of the present invention, the lap bib including a lap portion for covering the lap of a user, an abdomen portion for covering the abdomen of the user, an attached closure band for conveniently stowing and transporting the lap bib when not in use, and a plurality of retaining devices for securely holding a plurality of eating/drinking implements.

Referring to FIGS. 1 and 2, the present invention provides a lap bib 10 for use in a vehicle or the like. The lap bib 10 includes a lap portion 12 for covering the lap of a user, an abdomen portion 14 for covering the abdomen of the user, and an attached closure band 16 for conveniently stowing and transporting the lap bib 10 when not in use. Advantageously, the lap bib 10 protects the user's clothing while the user is eating or the like in an automobile; on a bus, train, or boat; in an airplane; at their desk; or the like.

The lap portion 12 and the abdomen portion 14 of the lap bib 10 each consist of a substantially absorbent material, such as an 80% cotton/20% polyester material or the like, backed by a substantially water-resistant material, such as a vinyl material or the like. The substantially absorbent material is designed to absorb any liquid spilled on it and the substantially water-resistant material is designed to keep the liquid away from the user's clothing. The substantially absorbent material may be joined with or bonded to the substantially water-resistant material using any suitable technique well known to those of ordinary skill in the art, including via stitching, gluing, etc. Alternatively, the substantially absorbent material and the substantially water resistant material may be one and the same material, such as a vinyl material, a neoprene material, or the like. Preferably, the lap bib 10 is made of a material that may be repeatedly laundered and dried and that is sufficiently non-slip on the lap of the user. The lap portion 12 and the abdomen portion 14 of the lap bib 10 may also incorporate a functional and/or decorative border 18 and have one or more decorative graphics or logos 20, such as corporate logos or advertisements, attached thereto (via a printing technique, stitching, gluing, etc.).

Preferably, the lap portion 12 of the lap bib 10 has a length 22 of between about 20 inches and about 35 inches and a width 24 of between about 6 inches and about 18 inches, although other suitable dimensions may be used. The abdomen portion 14 of the lap bib 10 has a width of between about 3 inches and about 10 inches, providing the lap bib 10 with an overall width 26 of between about 9 inches and about 28 inches, although other suitable dimensions may be used. In one exemplary embodiment of the present invention, the lap portion 12 of the lap bib 10 has a length 22 of about 28 inches and a width 24 of about 12 inches. The abdomen portion 14 of the lap bib 10 has a width of about 5 inches, providing the lap bib 10 with an overall width 26 of about 17 inches. It should be noted that the abdomen portion 14 of the lap bib 10 may have a substantially-squared to substantially-curved shape and the length of the abdomen portion 14 of the lap bib 10 may be equal to or less than the length 22 of the lap portion 12 of the lap bib 10. In general, the dimensions of the lap bib 10 are selected such that the lap bib 10 substantially covers the lap and abdomen of an average-sized user, protecting the user's clothing from spills and drips.

In one specific embodiment of the present invention, the lap bib 10 has sufficient rigidity and/or appropriate flexibility such that one or more eating/drinking implements 28, such as a plate or bowl, a knife, a fork, a spoon, a cup, and/or the like, may be supported on the upper surface 30 of the lap bib 10. Referring to FIG. 2, one or more retaining devices 32 and 34 may be used to securely hold the one or more eating/drinking implements 28. For example, a plurality of appropriately sized loops of fabric or the like 32 may be used to securely hold a knife, a fork, and a spoon. Likewise, a piece of hook-and-loop (Velcro)-type fabric or the like 34 may be used to securely hold a plate or bowl. A suitable cup-holder, well known to those of ordinary skill in the art, may also be used to securely hold a cup, as well as other retaining devices suitable for securely holding whatever it is that they are intended to retain.

Referring again to FIG. 1, in one preferred embodiment of the present invention, the lap bib 10 consists of a substantially flexible material and the upper surface 30 of the lap bib 10 incorporates one or more decorative graphics or logos 20, such as one or more decorative graphics depicting one or more eating/drinking implements 28 or the like.

Referring again to FIGS. 1 and 2, the lap bib 10 of the present invention includes an attached closure band 16 for conveniently stowing and transporting the lap bib 10 when not in use. Preferably, this attached closure band 16 consists of or incorporates a piece of hook-and-loop (Velcro)-type fabric, elastic fabric, or the like. The attached closure band 16 is disposed about the lap bib 10 and secured after the abdomen portion 14 has been folded into the lap portion 12 along a lengthwise line or seam 36. This stowing process is illustrated in FIG. 3.

Figure 3:
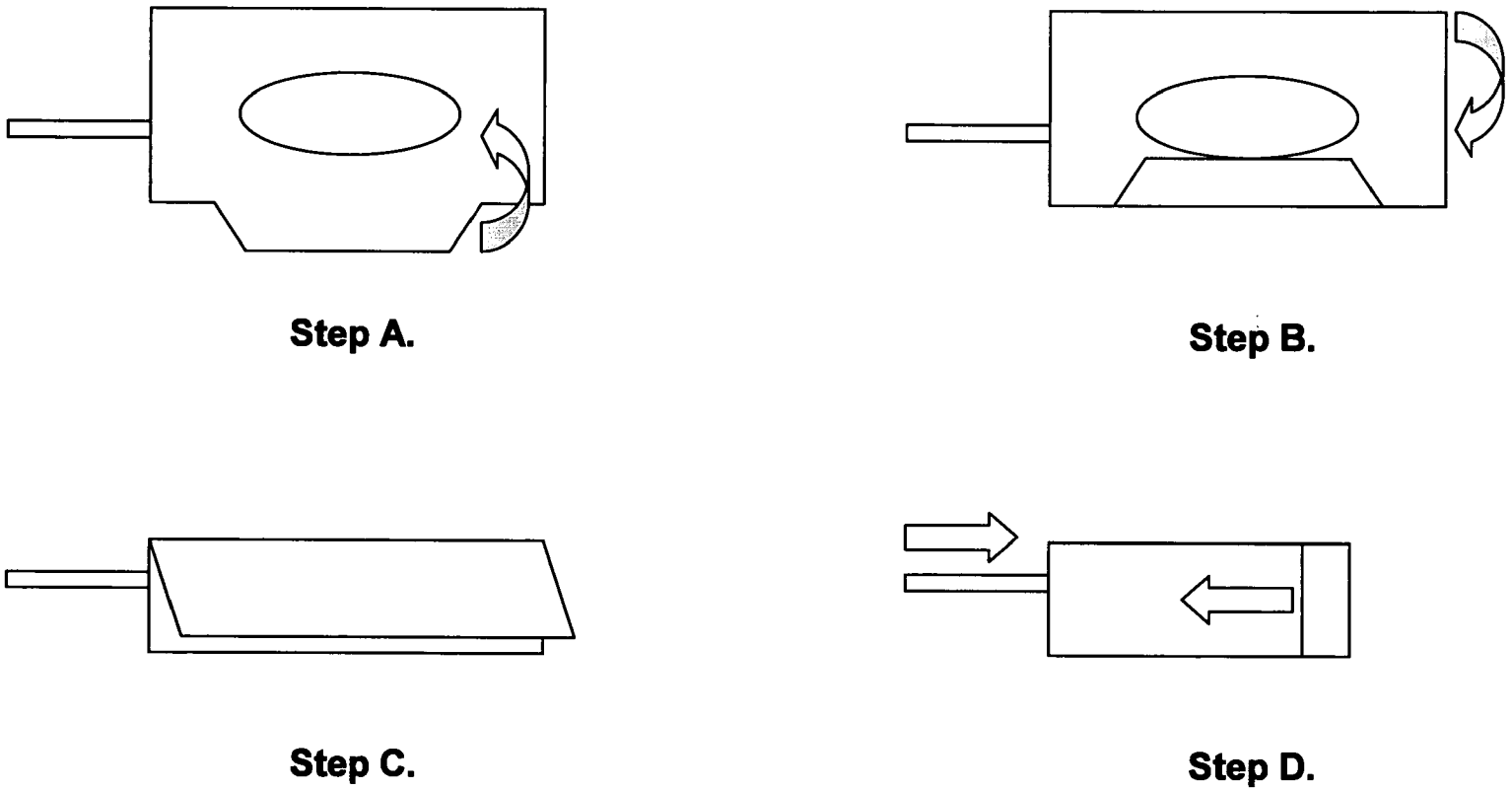
FIG. 3 is a series of perspective views illustrating the stowing of the lap bib of the present invention.

Referring to FIG. 3, the lap bib 10 (FIGS. 1 and 2) of the present invention is stowed by first folding the abdomen portion 14 (FIGS. 1 and 2) of the lap bib 10 into the lap portion 12 (FIGS. 1 and 2) of the lap bib 10. (Step A). The lap bib 10 is then folded in half lengthwise. (Step B). The folded lap bib 10 is then rolled lengthwise from the plain end to the end including the attached closure band 16 (FIGS. 1 and 2). (Step C). Finally, the rolled lap bib 10 is secured using the attached closure band 16. (Step D).

Although the present invention has been illustrated and described with reference to preferred embodiments and specific examples thereof, it should be noted that other embodiments and examples may perform the same functions and/or achieve similar results. All such equivalent embodiments and examples are within the scope and spirit of the present invention and are intended to be covered by the following claims.

What is claimed is:

1. A neck-less bib device for covering the lap and abdomen of a user, the bib device comprising:

a lap portion for covering the lap of the user;

an abdomen portion for covering the abdomen of the user, wherein a width of the lap portion is greater than a width of the abdomen portion, wherein the width of the lap portion corresponds to the length of leg covered by the lap portion and the width of the abdomen portion corresponds to the length of abdomen covered by the abdomen portion, respectively, and wherein the width of the abdomen portion is half or less than the width of the lap portion; and a closure band attached to the lap portion, the closure band disposed about the lap portion and the abdomen portion when the bib device is in a stowed configuration.

2. The bib device of claim 1, wherein the lap portion and the abdomen portion each comprise a material selected from the group consisting of a substantially absorbent material, a substantially water-resistant material, and a combination of a substantially absorbent material and a substantially water-resistant material.

3. The bib device of claim 1, wherein at least a portion of the closure band attached to the lap portion comprises a fabric selected from the group consisting of a hook-and-loop-type fabric and an elastic fabric.

4. The bib device of claim 1, further comprising one or more retaining devices attached to a surface of the lap portion.

5. The bib device of claim 1, further comprising one or more decorative graphics or logos disposed on a surface of the lap portion.

6. A method for providing a neck-less bib device for covering the lap and abdomen of a user, the method for providing the bib device comprising:

providing a lap portion for covering the lap of the user;

providing an abdomen portion for covering the abdomen of the user, wherein a width of the lap portion is greater than a width of the abdomen portion, wherein the width of the lap portion corresponds to the length of leg covered by the lap portion and the width of the abdomen portion corresponds to the length of abdomen covered by the abdomen portion, respectively, and wherein the width of the abdomen portion is half or less than the width of the lap portion; and providing a closure band attached to the lap portion, the closure band disposed about the lap portion and the abdomen portion when the bib device is in a stowed configuration.

7. The method for providing the bib device of claim 6, wherein the lap portion and the abdomen portion each comprise a material selected from the group consisting of a substantially absorbent material, a substantially water-resistant material, and a combination of a substantially absorbent material and a substantially water-resistant material.

8. The method for providing the bib device of claim 6, wherein at least a portion of the closure band attached to the lap portion comprises a fabric selected from the group consisting of a hook-and-loop-type fabric and an elastic fabric.

9. The method for providing the bib device of claim 6, further comprising providing one or more retaining devices attached to a surface of the lap portion.

10. The method for providing the bib device of claim 6, further comprising providing one or more decorative graphics or logos disposed on a surface of the lap portion.

* * * * *